US005423594A

United States Patent [19]

Hancock et al.

[11] Patent Number: 5,423,594

[45] Date of Patent: Jun. 13, 1995

[54] CHAIR TILTING MECHANISM

[75] Inventors: William J. Hancock; Steven W. Hancock, both of Wexford, Ireland

[73] Assignee: Ashfield Engineering Company Wexford Limited, Wexford, Ireland

[21] Appl. No.: 319,247

[22] Filed: Oct. 6, 1994

Related U.S. Application Data

[63] Continuation of Ser. No. 886,767, May 21, 1992, abandoned.

[30] Foreign Application Priority Data

| | | | |
|---|---|---|---|
| May 21, 1991 | [IE] | Ireland | 1724/91 |
| Jul. 18, 1991 | [IE] | Ireland | 2516/91 |
| Sep. 3, 1991 | [IE] | Ireland | 3089/91 |
| Mar. 10, 1992 | [IE] | Ireland | 770/92 |

[51] Int. Cl.[6] ..... A47C 3/00

[52] U.S. Cl. ..... 297/301; 297/320

[58] Field of Search ..... 297/300, 301, 320

[56] References Cited

U.S. PATENT DOCUMENTS

| | | | |
|---|---|---|---|
| 2,830,650 | 4/1958 | Lorenz | 155/77 |
| 2,859,799 | 11/1958 | Moore | 297/301 |
| 4,682,815 | 7/1987 | Steifensand | 297/300 |
| 4,684,173 | 8/1987 | Locher | 297/300 |
| 4,709,962 | 12/1987 | Steinmann | 297/300 X |
| 4,709,963 | 12/1987 | Uecker et al. | 297/300 X |
| 5,080,435 | 1/1992 | Desanta | 297/300 X |
| 5,150,948 | 9/1992 | Volkle | 297/301 |

FOREIGN PATENT DOCUMENTS

| | | | |
|---|---|---|---|
| 0341344 | 11/1989 | European Pat. Off. . | |
| 0418731 | 3/1991 | European Pat. Off. . | |
| 2067806 | 7/1971 | France . | |
| 1404662 | 2/1969 | Germany . | |
| 659179 | 1/1987 | Switzerland | 297/300 |

*Primary Examiner*—Peter M. Cuomo
*Assistant Examiner*—Suzanne L. Dino
*Attorney, Agent, or Firm*—Scully, Scott, Murphy & Presser

[57] ABSTRACT

A chair tilting mechanism (1) is disclosed which has a fixed support (2), a seat support (3) and a backrest support (4). The seat support (3) is pivotally connected to the fixed support (2) by a pivot pin (5). The backrest support (4) is pivotally connected to the seat support (3) by a pivot pin (6). There is additionally provided a link (7) connected by pivot pins (8,9) to the backrest support (4) and the seat support (2). Because of the link (7), rotation of either the backrest or seat support causes the other of the backrest or seat support to tilt in a predetermined synchronised manner. The manner in which synchronised tilting occurs is set by the interconnection of the various parts. The invention also provides a means (41) for pre-setting the interconnection.

7 Claims, 5 Drawing Sheets

20
2
3
5
24
25
25
9
7
6
4
8

20
29
31
30
32
20°
21
3
5
2
26
23
9
7
6
8
4
11°

CHAIR TILTING MECHANISM

This is a continuation of copending application Ser. No. 07/886,767 filed on May 21, 1992, now abandoned.

BACKGROUND OF THE INVENTION

Introduction

The invention relates to a tilting mechanism for a chair which has fixed, seat and backrest supports the fixed and seat supports being pivotally interconnected. An example is an office chair having a central spindle which is secured to the fixed support.

Prior Art

British Patent Specification No. GB 2,193,884 (Chair Mechanisms Limited) show a chair adjustment mechanism which has channel-shaped housing which form pivotally interconnected seat and fixed supports. The fixed support is constructed to be secured to a spindle supporting a chair. A bracket forming a backrest support is pivotally connected to the seat support. Clutch leaves are mounted between the backrest and fixed supports and between the fixed and seat supports so that the supports may be clamped at a desired tilting position in relation to each other. A problem with this arrangement is that when the clutch is disengaged tilting adjustment of the seat and backrest are not related and it is difficult of a user to find the correct tilting angles.

OBJECTS OF THE INVENTION

One object of the invention is to provide a chair tilting mechanism which ensures that movement of either the seat or the backrest causes movement of the other in a pre-determined manner. Such tilting is hereinafter referred to as synchronised tilting.

Another object is that the initial angle between a backrest and seat may be set as desired before synchronised tilting begins.

SUMMARY OF THE INVENTION

The invention provides a chair tilting mechanism having a fixed support and a seat support which are pivotally interconnected. There is also a backrest support which is pivotally connected to the seat support. The pivot connections allow pivoting movement of the seat support with respect to the fixed support and of the backrest support with respect to the seat support. The mechanism also includes a link which is pivotally connected at its ends to the backrest support and to the fixed support. Thus, the backrest support is directly pivotally connected to the seat support and is connected via the link to the fixed support. Accordingly, in use, tilting of the seat or backrest will cause the other of the seat or backrest to tilt in a pre-determined manner, depending on the dimensions of the various parts of the mechanism. This allows synchronised tilting to be achieved.

Preferably, the link is pivotally connected to the backrest support adjacent a lower end and the pivot connection between the backrest and seat supports is above this connection.

Ideally, means are provided for pre-setting interconnection of parts of the mechanism so that an initial angle between the backrest and seat may be set before synchronised tilting begins. For example, means may be provided for pre-setting the effective length of the link.

BRIEF DESCRIPTION OF THE DRAWINGS

The invention will be more clearly understood from the following description of some preferred embodiments thereof, given by way of example only, with reference to the accompanying drawings in which.

DETAILED DESCRIPTION OF THE PREFERRED EMBODIMENT

Figure 1A:
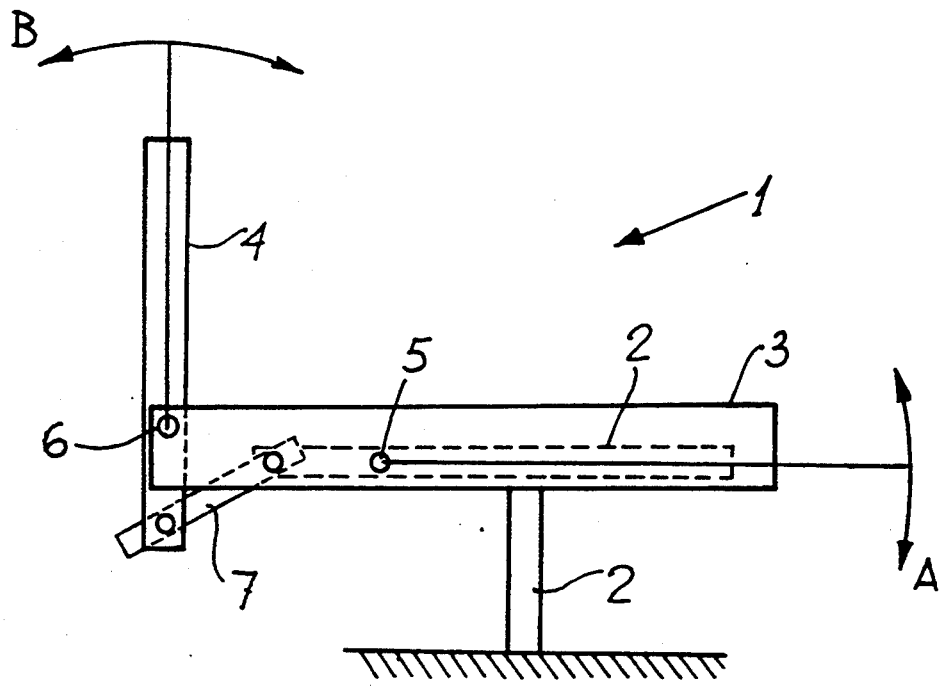
FIG. 1(*a*) and 1(*b*) are diagrammatic sketches showing the principle of the invention.

Before describing the embodiments in detail, principles of the invention will now be described with reference to the sketches of FIG. 1. The sketches do not show a practical embodiment but merely illustrate the essential functional characteristics of the invention. The sketches shows a chair tilting mechanism 1 having a fixed support 2, a seat support 3 and a backrest support 4. The seat and fixed supports are pivotally interconnected at a pivot pin 5 and the backrest and seat supports are pivotally interconnected at a pivot pin 6. The backrest support 4 protrudes downwardly below the level of the pin 6 and at its lower end it is pivotally connected to a link 7 by a pivot pin 8. The link 7 is in turn pivotally connected to the fixed support 2 by a pivot pin 9.

Figure 1B:
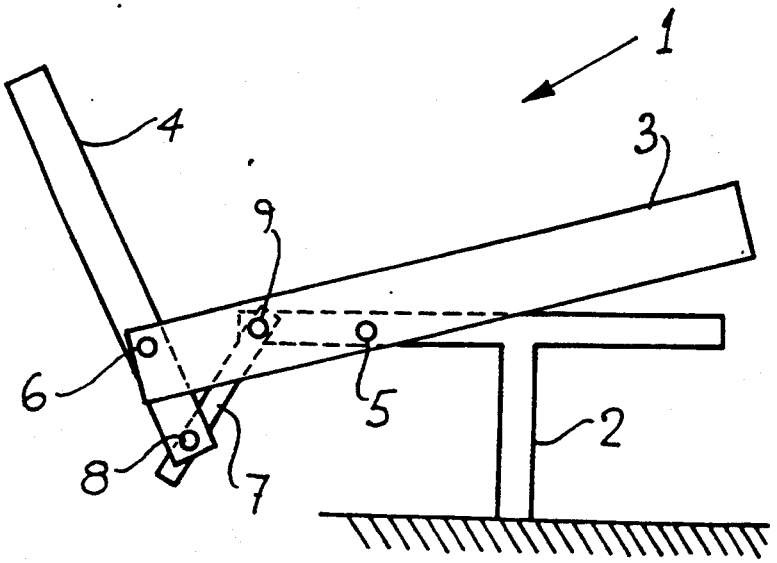
Figures 2, 3:
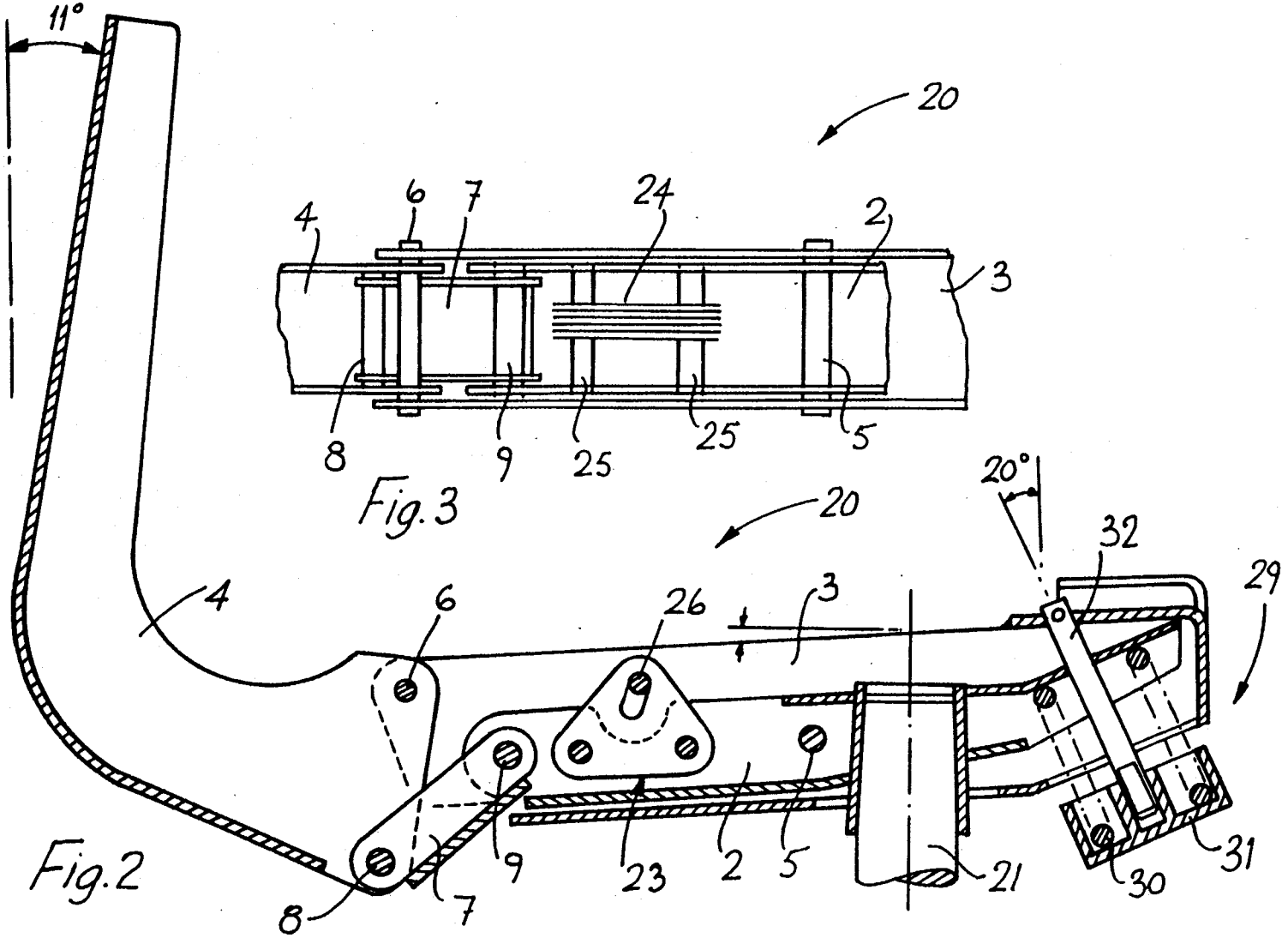
FIG. 2 is a diagrammatic cross-sectional side view of a tilting mechanism of the invention.
FIG. 3 is a diagrammatic plan view of portion of the mechanism of FIG. 2.

Regarding the position of FIG. 1(*a*) as being the starting position, consider initially what would happen if a person sitting in a chair having the mechanism 1 were to shift his or her body weight backwardly. This action would cause the seat support 3 to rotate about the pin 5 in the anti-clockwise direction (upward arrow A). The pin 6 and the backrest support 4 would follow this movement. However, the pin 8 would be forced to follow a circular arc about the pin 9, because the pin 9 is fixed in position on the fixed support 2. This causes the backrest support 4 to rotate in the anti-clockwise direction about the pin 6. The resulting position of the mechanism 1 is shown in FIG. 1(*b*). Clearly, the reverse happens when the person's weight is shifted forwardly to rotate the seat support 3 in the clockwise direction, bringing the mechanism 1 back to the position of FIG. 1(*a*).

It will thus be appreciated that the mechanism 1 causes the tilting motions of the seat and backrest supports to be related, or synchronised. This is referred to hereinafter as synchronised tilting. The manner of synchronised tilting (i.e. the relationship between the tilting motions) is set by the dimensions of the various parts such as the length of the link 7, distance between the pins 6 and 8, and between the pins 9 and 5. It will be appreciated, for example, that if the effective length of the link 7 were changed, the initial angle between the seat and backrest supports 3 and 4 would be changed, as would the manner in which synchronised tilting occurs.

The sketches of FIG. 1 show the principles of the invention. How they are implemented in actual mechanisms is now described with reference to FIGS. 2 to 7 inclusive.

Referring initially to FIGS. 2 to 5 there is illustrated a chair tilting mechanism 20 in which parts which are functionally equivalent to parts of FIG. 1 are identified by the same reference numerals.. The fixed support 2 is of steel channel construction and is shown secured to a spindle 21 supporting an office chair. The seat support 3 is also of steel channel construction and surrounds the fixed support 2. The backrest support 4 is in the form of a backstem, the end of which engages the pivot pins 6 and 8. The link 7 is also of steel channel construction.

The mechanism 20 also includes a clutch 23 having clutch leaves 24 mounted between the fixed and seat supports 2 and 3. More specifically, the leaves 24 engage pins 25 in the fixed support 2 and a shaft assembly 26 in the seat support 3. The shaft assembly 26 has a cam handle 27 protruding to one side. This is not shown in FIGS. 2 to 4, only in FIG. 5. Conical spring washers 28 are used to allow clamping of the leaves 24 by the shaft assembly 26. The clutch 23 is in the normally-disengaged position as it requires a positive movement of the handle 27 to cause the leaves 24 to be clamped.

The mechanism 20 also includes a spring unit 29 which is mounted between the fixed and seat supports to bias the seat support about the pin 5 in the clockwise direction. The spring unit 29 comprises a spring 30 anchored at one end to the fixed support 2 and its lower end is housed within a tension adjusting knob 31 to urge it downwardly. The knob 31 is connected to the seat support 3 by a rod 32.

Figure 4:
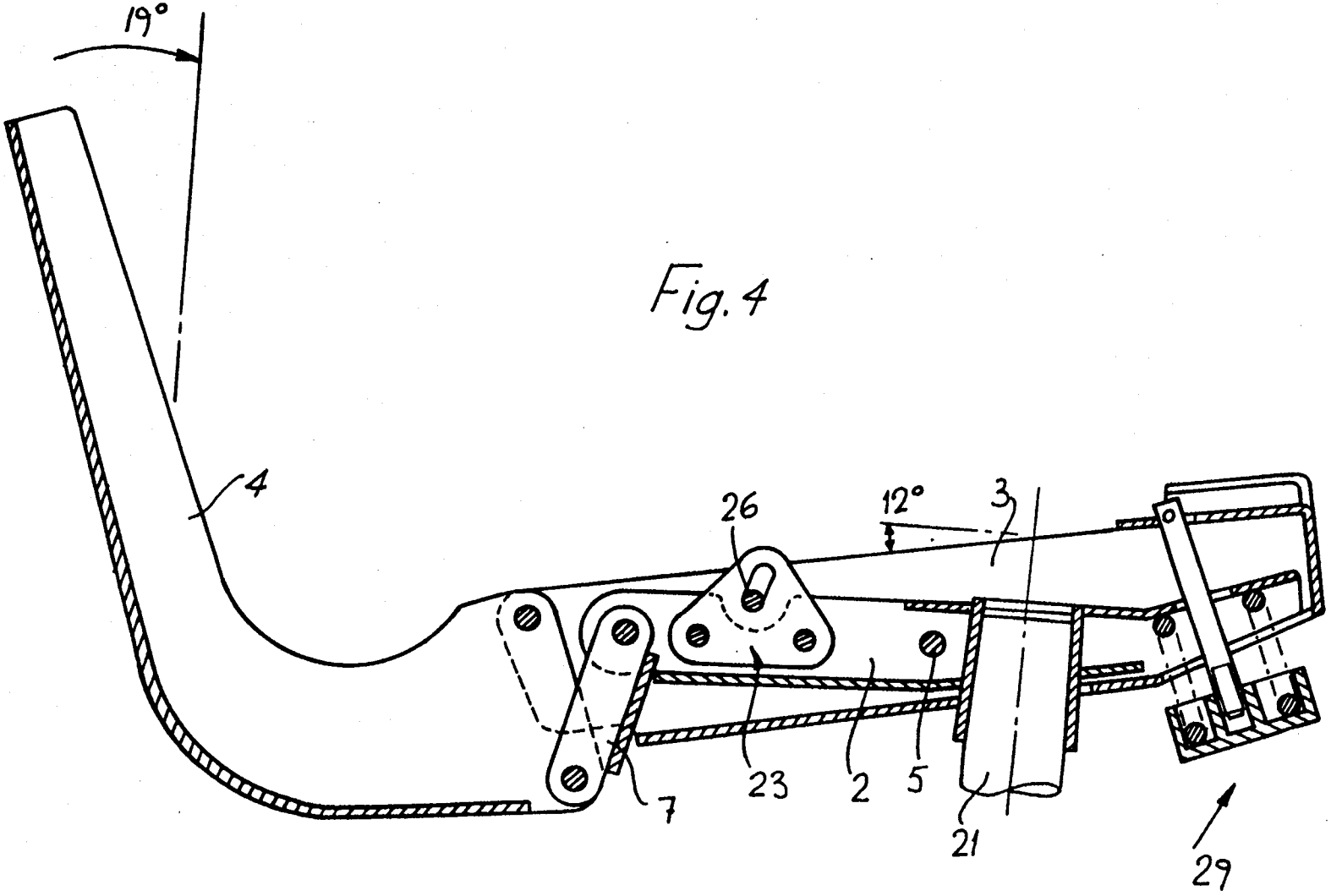
FIG. 4 is a diagrammatic cross-sectional side view of the mechanism of FIG. 2 at a different tilting position.
Figure 5:
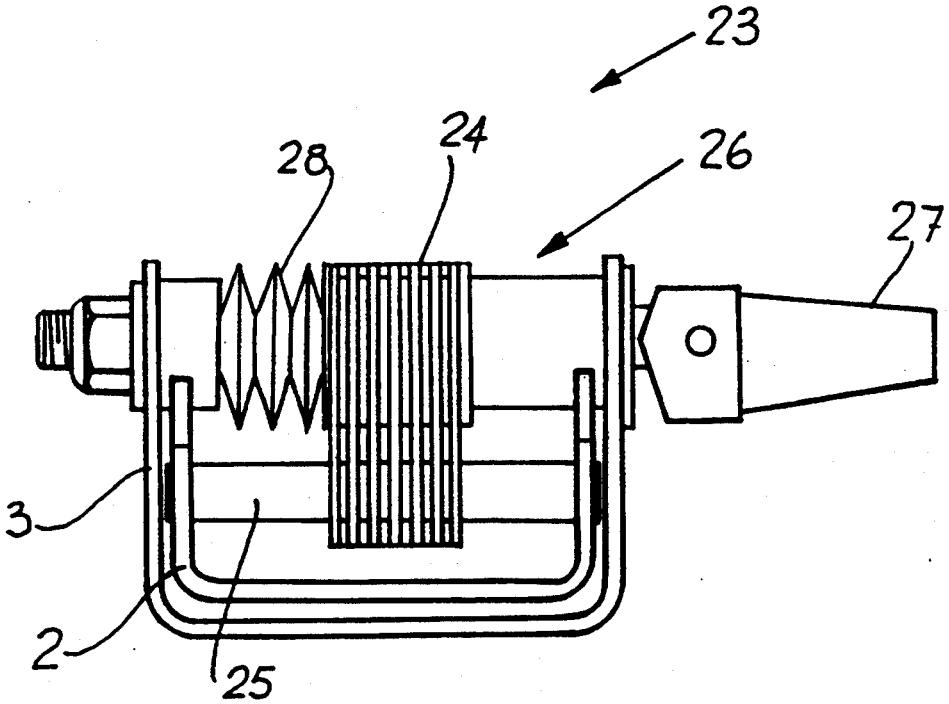
FIG. 5 is an end view of a clutch of the mechanism.

To envisage operation of the mechanism 20 the clutch 23 should be initially disregarded. The clutch 23 is only used if it is desired to lock the fixed, seat and backrest supports at a particular position. More often, however, the clutch 23 would be disengaged and the seat and backrest supports would be free to tilt with respect to each other and the fixed support while being biased to a "normal" position by the spring unit 29. This position is that shown in FIG. 2 and a person sitting on a chair with the mechanism at this position would have adequate seat and back support as the spring 30 is quite strong and would prevent unintentional tilting. If the person shifts his or her body weight backwardly, urging the seat support 3 in an anti-clockwise direction about the pin 5, the backrest support 4 is tilted backwardly, as described with reference to FIG. 1. The resulting position is shown in FIG. 4 in which the backrest support has tilted a total of 30°, while the seat support 3 has tilted by 9°.

Thus, the invention allows a user to lean backwardly and forwardly in a chair, the force required to cause tilting being set by the adjustable knob 31 of the spring unit 29. When tilting is caused, both the backrest and seat tilt with respect to each other or with respect to the fixed support 2 in a pre-determined manner. This provides for user comfort at all times. If for some reason synchronised tilting is not required and the user simply wishes to lock the seat and backrest at a particular position, the clutch 23 is engaged. While synchronised tilting occurs, there are large stresses transferred through the mechanism. Reliability of the mechanism is ensured because the link 7 is of high strength construction and because it is connected by the pin 9 directly to the fixed support 2, which is itself of high strength channel construction. Connection of the backrest support directed to the fixed support by a link is important as it ensures reliability and safety for synchronised tilting. Another important advantage is that the mechanism 20 may be quite "shallow", i.e. it would not protrude downwardly very much below the seat. This arises because the fixed support 2 extends back to the extent that it may be linked directly to the backrest support 4. In this embodiment, the mechanism 2 is only 5 cm high and may be concealed by a low moulded shroud.

The invention also provides for changing the interrelationship of parts of the mechanism so the manner of synchronised tilting may be pre-set. One way of achieving this is to allow for changing the effective length of the link, as shown in FIGS. 6 and 7.

Figures 6, 7:
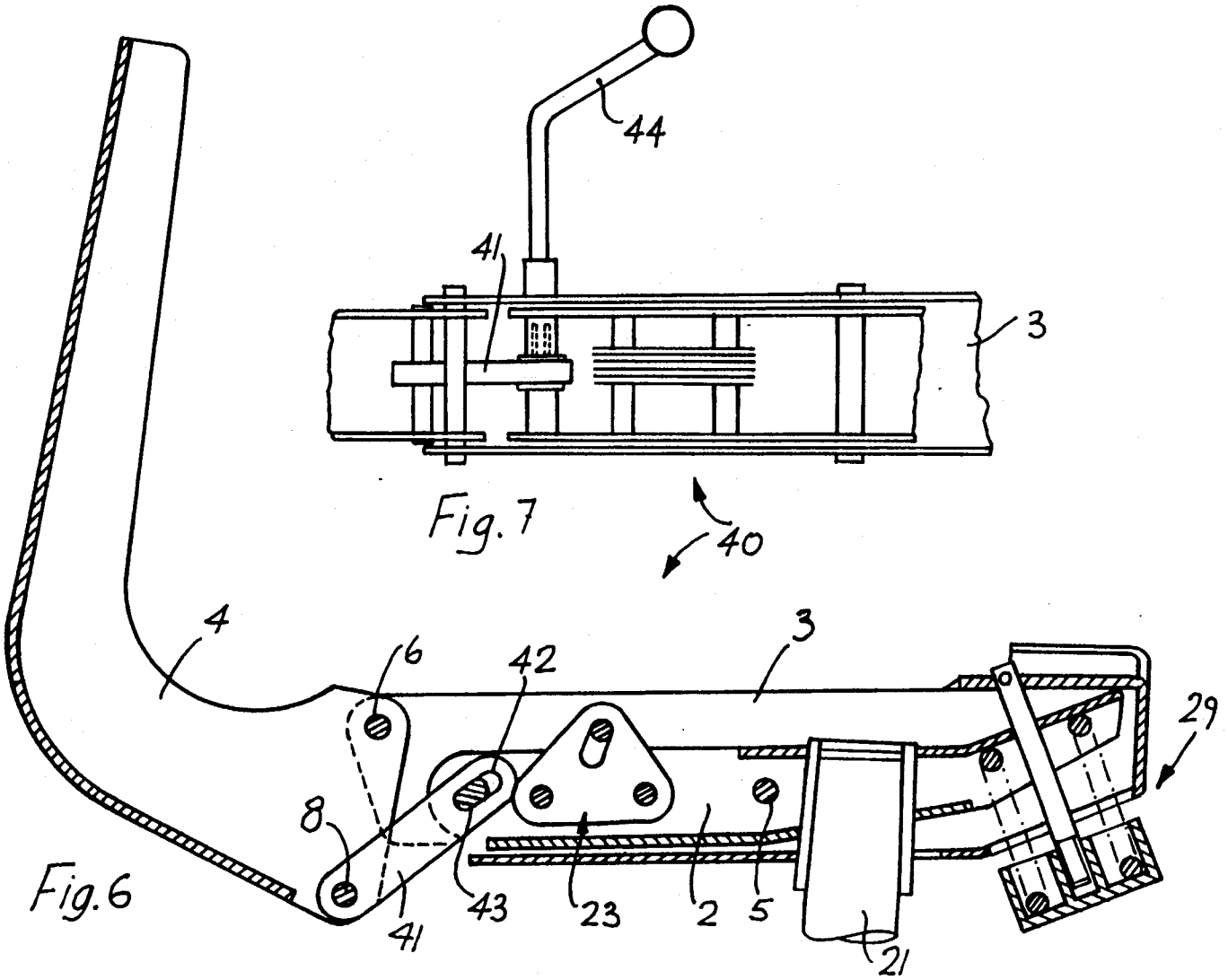
FIG. 6 is a cross-sectional side view of another construction of tilting mechanism of the invention.
FIG. 7 is a plan view of portion of the mechanism of FIG. 6.

Referring now to FIGS. 6 and 7 there is illustrated an alternative construction of chair tilting mechanism, indicated generally by the reference numeral 40. Parts similar to those described with reference to the previous drawings are identified by the same reference numerals. In this embodiment there is a link 41, the effective length of which may be preset to a desired length. The link 41 comprises a slot 42 which engages a pin 43 in the fixed support 2. The pin 43 is threaded at one end at which it engages a rotatable handle 44. At the link 41, the pin 43 is of elongate cross-section (see FIG. 6). Clamping thrust washers 45 are carried on the pin 43 and on the handle 44 on each side of the link 41.

In operation, before the seat is used, a user may release pressure on the link 41 by turning the handle 44. He or she may then move the backrest support 4 independently of the seat support 3 and the fixed support 2. This is allowed because the link 41 may be moved within the range set by the slot 42 and the pin 43. When the desired angle between the backrest and seat is achieved, the handle 42 is turned to lock the link 41 at a certain position with respect to the pin 43. This operation changes the effective length of the link 41 (i.e. the distance between the pins 8 and 43). Thus, not only is the initial angle between the backrest and seat set to a desired angle, but the manner in which synchronised tilting occurs afterwards is also set according to the new effective length of the link 41. In other words, the angular relationship of 9° for the seat support to 30° for the backrest support may be changed. This is an extremely important aspect of the invention as it allows a single chair mechanism to be used with many different types of chairs which are designed for different types of individuals.

The invention is not limited to the embodiments hereinbefore described, but may be varied in construction and detail. For example, the supports may be of plastics rather than steel construction. A locking device such as the clutch 23 may be used for setting the effective length of the link. It is envisaged that the initial backrest/seat angle and the manner of synchronised tilting may be pre-set other than by changing the effective length of the link. For example, there may be different positions on the backrest support for the pin 8, or indeed on the backrest or seat supports for the pin 6. Where the means for pre-setting the initial angle is a means for changing the effective length of the link, it is envisaged that this may be changed in any other convenient way. For example, there may be a slot at the end engaging the backrest support 4, or indeed a telescoping link could be used.

We claim:

1. A chair tilting mechanism comprising:

a) a fixed support having means for connection to a ground-engaging part of a chair;

b) a seat support having means for supporting a seat for the chair;

c) a first pivot connection between the seat and fixed supports;

d) a backrest support having an upper end and a lower end;

e) a second pivot connection between the backrest and seat supports, said pivot connection being located rearwardly of the first pivot connection and having a pivot axis which is substantially parallel to that of the first pivot connection;

f) biasing means mounted between the fixed and seat supports, said biasing means acting between anchorages on the fixed and seat supports which are located forwardly of the first pivot connection;

g) a single elongate link member having means for forming pivot connections at opposite ends thereof;

h) a third pivot connection between one end of said link member and the backrest support; and i) a fourth pivot connection between the opposite end of said link member and the fixed support, said third and fourth pivot connections completing interconnection of the fixed, seat and backrest supports for synchronized tilting of the seat support with respect to the backrest support.

2. A mechanism as claimed in claim 1, wherein the third pivot connection is between the second pivot connection and the lower end of the backrest support for downward action of the backrest support on the seat support at the second ]pivot connection on rearward rotation of the backrest support, and said biasing means is mounted to urge the seat support downwardly to counteract the action of the backrest support on the seat support.

3. A mechanism as claimed in claim 2, wherein the seat support anchorage for the biasing means is mounted at a higher level than the fixed support anchorage for the biasing means, said biasing means acting to pull the anchorages closer together in compression.

4. A mechanism as claimed in claim 1, further comprising means for pre-setting interconnection of parts of the mechanism so that the initial angle between the backrest and seat supports is settable before the beginning of synchronizing tilting.

5. Mechanism as claimed in claim 4, wherein the presetting means comprises means for setting a desired effective length of the link member.

6. A mechanism as claimed in claim 5, wherein the pre-setting means comprises a link member pivot connection having a pin engaging a slot and a lock mounted for locking the pin at a selected position of the slot.

7. A mechanism as claimed in claim 1, wherein said elongate link member consists of a rigid element.

* * * * *

UNITED STATES PATENT AND TRADEMARK OFFICE

CERTIFICATE OF CORRECTION

PATENT NO. : 5,423,594

DATED : June 13, 1995

INVENTOR(S) : William J. Hancock, et al

It is certified that error appears in the above-indentified patent and that said Letters Patent is hereby corrected as shown below:

On the Title Page, Section [56], under "FOREIGN PATENT DOCUMENTS", line 5, insert the following:

--2193884 2/88 Great Britain--

Column 1, line 17: before "British" insert --Figs. 6 and 7 of--

Column 1, line 18: "adjustment" should read --tilting--

Column 1, line 19: "housing" should read --housings--

Column 1, line 30: "of" should read --for--

Column 3, line 6: "numerals.." should read --numerals.--

UNITED STATES PATENT AND TRADEMARK OFFICE

CERTIFICATE OF CORRECTION

PATENT NO. : 5,423,594

DATED : June 13, 1995

INVENTOR(S) : William J. Hancock, et al

It is certified that error appears in the above-indentified patent and that said Letters Patent is hereby corrected as shown below:

Column 6, line 3, Claim 2: delete "]"

Signed and Sealed this

Seventh Day of November, 1995

Bruce Lehman

*Attest:*

BRUCE LEHMAN

*Attesting Officer*

*Commissioner of Patents and Trademarks*